US006659791B1

(12) United States Patent
Ko et al.

(10) Patent No.: US 6,659,791 B1
(45) Date of Patent: Dec. 9, 2003

(54) MICRO COAXIAL CABLE CONNECTOR HAVING LATCHES FOR SECURELY ENGAGING WITH A COMPLEMENTARY CONNECTOR

(75) Inventors: David Tso-Chin Ko, Fullerton, CA (US); Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/246,259

(22) Filed: Sep. 17, 2002

Related U.S. Application Data

(63) Continuation-in-part of application No. 10/199,713, filed on Jul. 19, 2002.

(51) Int. Cl.[7] ..... H01R 13/627

(52) U.S. Cl. ..... 439/353; 434/607; 434/497

(58) Field of Search ..... 439/353, 350, 439/357, 358, 607, 610, 497, 579, 354

(56) References Cited

U.S. PATENT DOCUMENTS 5,380,223 A * 1/1995 Marsh et al. ..... 439/610
5,545,052 A * 8/1996 Hirai ..... 439/354
5,775,931 A 7/1998 Jones
5,934,942 A * 8/1999 Patel et al. ..... 439/610
5,941,725 A * 8/1999 Brennan et al. ..... 439/357
6,238,227 B1 * 5/2001 Wu et al. ..... 439/260
D444,130 S 6/2001 Hayashi et al.
6,273,749 B1 * 8/2001 Yang ..... 439/497
6,273,753 B1 8/2001 Ko
6,305,978 B1 10/2001 Ko et al.
6,338,652 B1 1/2002 Ko
D456,777 S 5/2002 Igarashi
D456,779 S 5/2002 Igarashi
D456,780 S 5/2002 Igarashi
D457,138 S 5/2002 Igarashi

* cited by examiner

*Primary Examiner*—Hien Vu
(74) *Attorney, Agent, or Firm*—Wei Te Chung

(57) ABSTRACT

An electrical connector comprises an insulative housing (1), a contact set (2) assembled into the housing, a shield (3) enclosing the housing, and a pair of latch devices (4) assembled to the housing. The housing comprises a base portion (11), a plurality of passageways (111) defined in the base portion, a pair of retention portions (14) at a pair of ends thereof. The contact set comprises an insulative insert (21), a plurality of signal and grounding contacts (22) received in the insert, and a grounding bar (23) assembled in the insert. The signal and grounding contacts extend into the passageways. The pair of latch devices is assembled to the retention portions and each latch device comprises a latch portion (414) extending through a passageway (148) defined in a guide posts (145) of the housing. Each latch device has a tab (419) engaging with the housing.

10 Claims, 8 Drawing Sheets

MICRO COAXIAL CABLE CONNECTOR HAVING LATCHES FOR SECURELY ENGAGING WITH A COMPLEMENTARY CONNECTOR

CROSS-REFERENCE TO RELATED APPLICATION

This patent application is a continuation-in-part (C-I-P) application of U.S. patent application Ser. No. 10/199,713, filed on Jul. 19, 2002, invented by David Tso-Chin Ko, entitled "MICRO COAXIAL CABLE CONNECTOR HAVING LATCHES FOR SECURELY ENGAGING WITH A COMPLEMENTARY CONNECTOR", and as signed to the same assignee of this patent application.

BACKGROUND OF THE INVENTION

1. Field of the Invention

The present invention relates to a micro coaxial cable connector used in liquid crystal display (LCD) application, and particularly to such connector having improved latches for reliably securing the connector to a complementary connector mounted in an LCD panel.

2. Description of Related Art

U.S. Pat. Nos. 6,305,978 B1, 6,273,753 B1, 6,338,652 B1, D456,779 S, D456,780 S, D456,777 S, D457,138 S, and D444,130 S disclose low profiled micro coaxial cable connectors. This type connector is used to transmit signals between a mother board in a base of a notebook computer and an LCD panel of the notebook computer. The micro coaxial cable connector must securely engage with a complementary connector in the LCD panel, because the LCD panel is frequently pivoted relative to the base of the notebook computer. In the old design, the micro coaxial cable connector has no locking device for latching with the complementary connector when the two connectors are connected together. This cannot ensure a reliably secure connection between the two connectors, whereby the cable connector may be unintentionally disconnected from the complementary connector, and the signal transmission between the two connectors is broken. The parent application, i.e., U.S. patent application Ser. No. 10/199,713 disclosed a micro coaxial cable connector having a latch device for securely engaging with a complementary connector to overcome the disadvantages of the prior art. The present invention is a further improvement of the connector shown in the '713 application.

SUMMARY OF THE INVENTION

Accordingly, one object of the present invention is to provide a micro coaxial cable connector having latches for securely engaging with a complementary connector.

In order to achieve the object set forth, an electrical connector comprising an insulative housing, a contact set received in the housing, a shield enclosing the housing, and a pair of latch devices assembled to the housing for locking with a mating connector. The housing comprises a base portion, a plurality of passageways defined in the base portion, and a pair of retention portions at a pair of lateral ends of the base portion. The contact set is assembled to a rear end of the housing and comprises an insulative insert, a plurality of signal and grounding contacts received in the insert, and a grounding bar assembled in the insert. The signal and grounding contacts extend forwardly into the passageways of the housing. The grounding bar has a plurality of grounding fingers electrically connecting the grounding contacts. The grounding plate is located above the contacts set for grounding. The pair of latch devices is assembled to the retention portions of the housing and each latch device has a latch portion for latching with a mating connector. The latch devices are pivotably mounted to retention posts integrally formed with the retention portions. The latch portions extend through passageways defined in guide posts integrally formed on front ends of the retention portions.

Other objects, advantages and novel features of the invention will become more apparent from the following detailed description when taken in conjunction with the accompanying drawings.

DETAILED DESCRIPTION OF THE INVENTION

Figure 1:
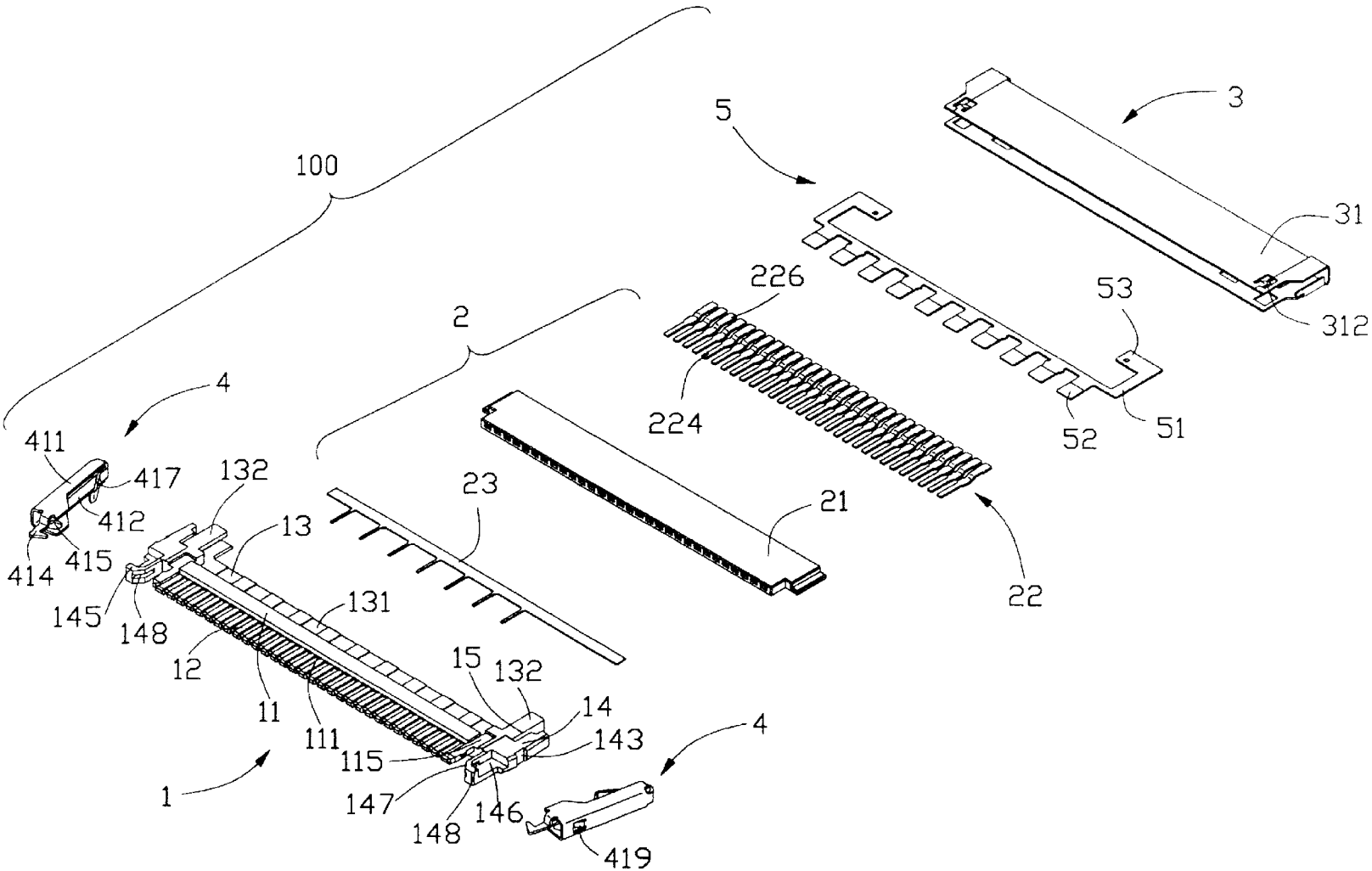
FIG. 1 is an exploded view of a micro coaxial cable connector in accordance with the present invention.
Figure 2:
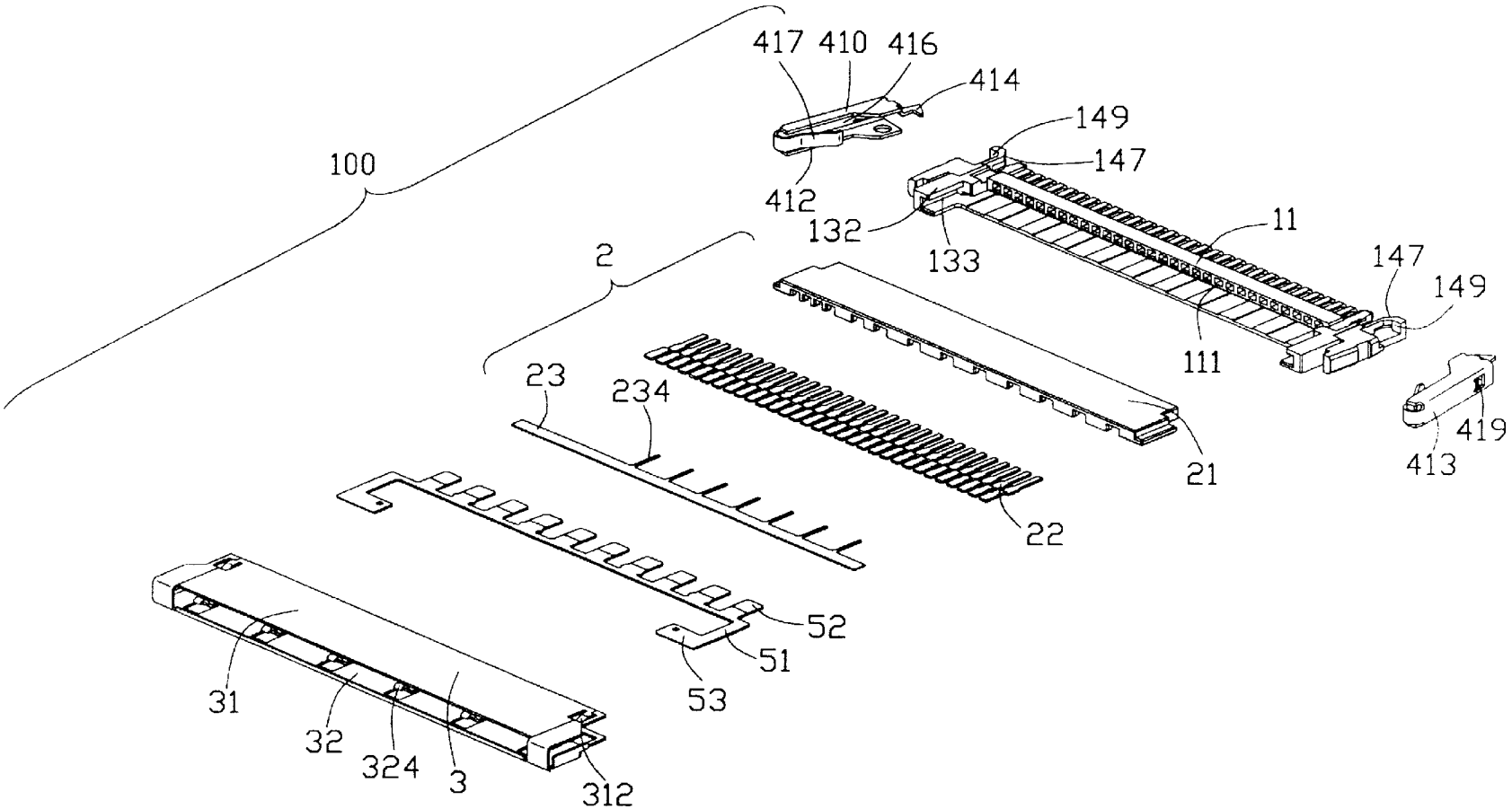
FIG. 2 is a view similar to FIG. 1, from a different aspect.
Figure 3:
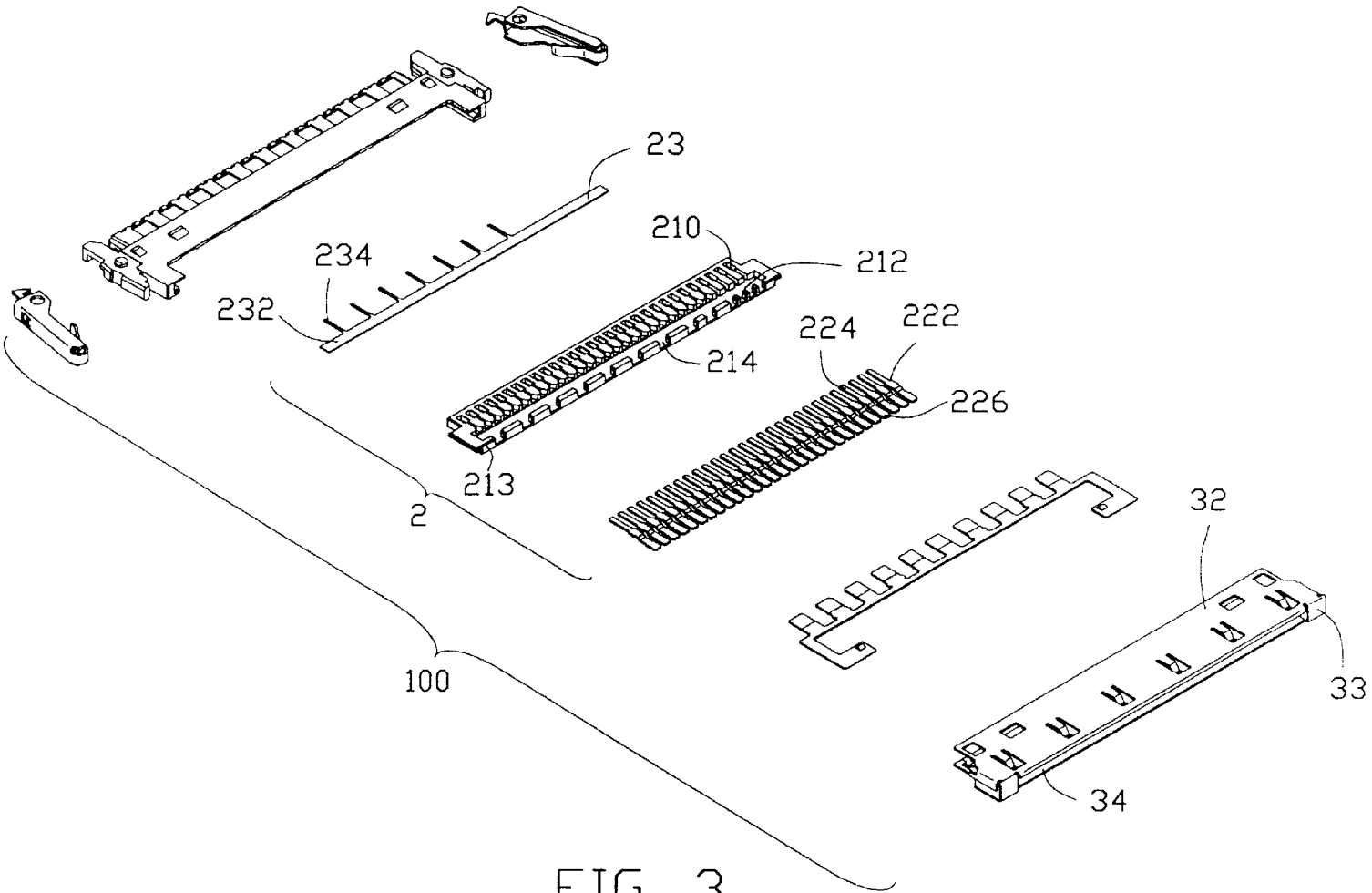
FIG. 3 is a view similar to FIG. 1, from a further different aspect.

Referring to FIGS. 1, 2 and 3, a micro coaxial cable connector 100 of the present invention comprises an elongate insulative housing 1, a contact set 2 , a shield 3, a pair of latch devices 4, and a conductive grounding plate 5.

Figure 4:
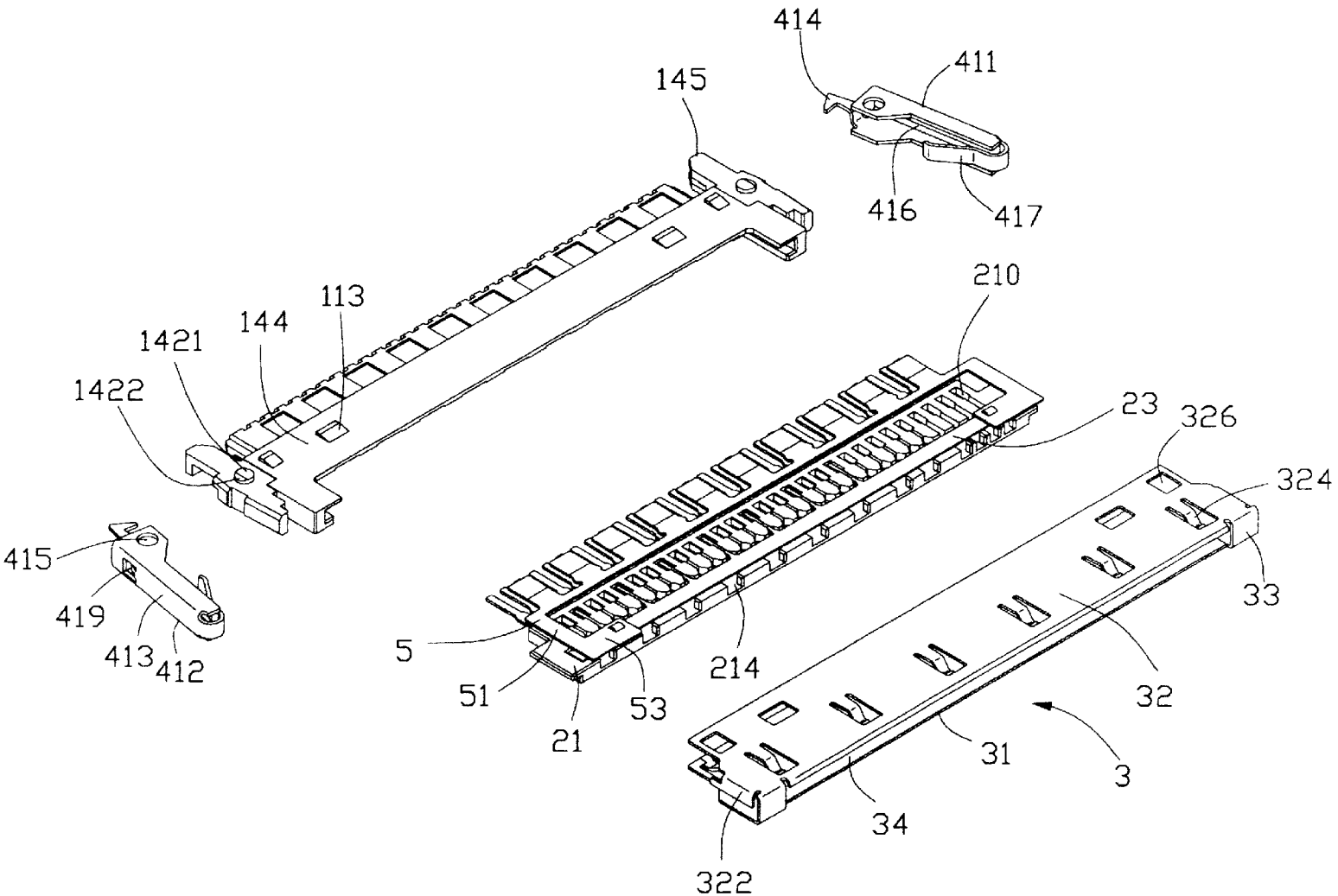
FIG. 4 is a partly assembled view of the micro coaxial cable connector of FIG. 3.

The insulative housing 1 comprises an elongate base portion 11, a tongue portion 12 extending forwardly from the base portion 11, a rear portion 13 at a rear end of the base portion 11, and a pair of retention portions 14 formed on lateral ends of the base portion 1l. The base portion 11 and the tongue portion 12 together define a plurality of passageways 111 from the rear end of the base portion 11 to a front end of the tongue portion 12. The rear portion 13 comprises an elongate plate 131 extending rearwardly from the base portion 11, a pair of receiving sections 132 formed on lateral ends of the elongate plate 131. Each of the receiving sections 132 defines a receiving channel 133 in an inner side thereof. A gap 15 is defined between each retention portion 14 and a corresponding receiving section 132. A retention post 142 is formed on a bottom surface of each of the retention portions 14, and the posts 142 each comprise a bottom face 1421 with a laterally inclining portion 1422 (FIG. 4) for facilitating mounting of latches onto the retention portions 14. A pair of guiding posts 145 extends forwardly from front ends of the retention portions 14 and each guiding post 145 has a recess 146 in a top face thereof. The recess is so located that an upright wall 149 is formed on front and inner edges of the each guiding post 145. The guiding posts 145 have flared front ends 147 for facilitating a mating of a complementary connector with the connector 100. A passageway 148 is defined in each of the upright walls 149, communicating with a corresponding recess 146 and extending from a corresponding flared front end 147 rearwards a distance. A plurality of protrusions 113 is formed on a bottom face 144 of the base portion 11 (FIG. 4). A pair of recesses 115 is defined in an upper surface face of the base portion 11 adjacent to the retention portions 14.

The contact set 2 comprises an insulative insert 21, a plurality of signal and grounding contacts 22, and a grounding bar 23.

The insulative insert 21 defines a plurality of channels 210 adjacent to a front end thereof, a receiving groove 212 adjacent to a rear end thereof. The channels 210 communicate with the receiving groove 212. The channels 210 are extended in a front-to-rear direction. The groove 212 is laterally extended. A plurality of slots 214 extends through a rear face 213 of the insert 21 and communicates with the receiving groove 212. The slots 214 are used to allow a plurality of wires of a cable (not shown) extending therethrough into the receiving groove 212 and the channels 210.

The signal and grounding contacts 22 have the same structure; each contact 22 comprises a retention section 222, a mating section 224 extending forwardly from the retention section 222, and a connecting section 226 extending rearwardly from the retention section 222. The mating sections 224 are for electrically engaging with the complementary connector. The connecting sections 226 are for electrically connecting with the wires of the cable.

The grounding bar 23 comprises an elongate, laterally extending main portion 232 and a plurality of grounding fingers 234 extending forwardly from the main portion 232.

The shield 3 comprises an upper plate 31, a lower plate 32, and a pair of connecting portions 33 connecting rear portions of the upper plate 31 and the lower plate 32. A receiving space 34 is defined between the upper and the lower plates 31 and 32. A pair of side portions 322 extends from a pair of lateral ends of the lower plate 32 to the upper plate 31. A plurality of resilient tabs 324 extends from the lower plate 32 into the receiving space 34 and a plurality of apertures 326 is defined in the lower plate 32. A pair of resilient bars 312 extends from the upper plate 31 into the receiving space 34.

Each latch device 4 comprises a U-shaped body portion 410 which has a top plate 411, a bottom plate 412, and a side plate 413 connecting side edges of the top and bottom plates 411, 412. The top plate 411, the bottom plate 412, and the side plate 413 together define a receiving cavity 416. The top plate 411 has a latch portion 414 in a configuration of a claw extending forwardly from a front end thereof. The latch portion 414 extends through a corresponding passageway 148 when the latch device 4 is mounted on a corresponding retention portion 14. A retaining hole 415 is defined through the bottom plate 412 of the body portion 410. A spring tab 417 extends forwardly from a rear end of the side plate 413 of the body portion 410 and in a direction away from the side plate 413. A tab 419 is formed by the side plate 413 and extends inwardly. The tab 419 is used for engaging in a depression 143 defined in a side face of a corresponding retention portion 14 when the latch device 4 is mounted on the corresponding retention portion 14, whereby the latch device 4 can be more stably mounted to the corresponding retention portion 14.

The grounding plate 5 has a connecting section 51, a plurality of grounding finger 52 and a pair of grounding beam 53 extending from two opposite ends of the connecting portion 51. Each of the grounding beam 53 is generally in the shape of the latter L so that a free end thereof may reliably engage with the grounding bar 23.

Figure 5:
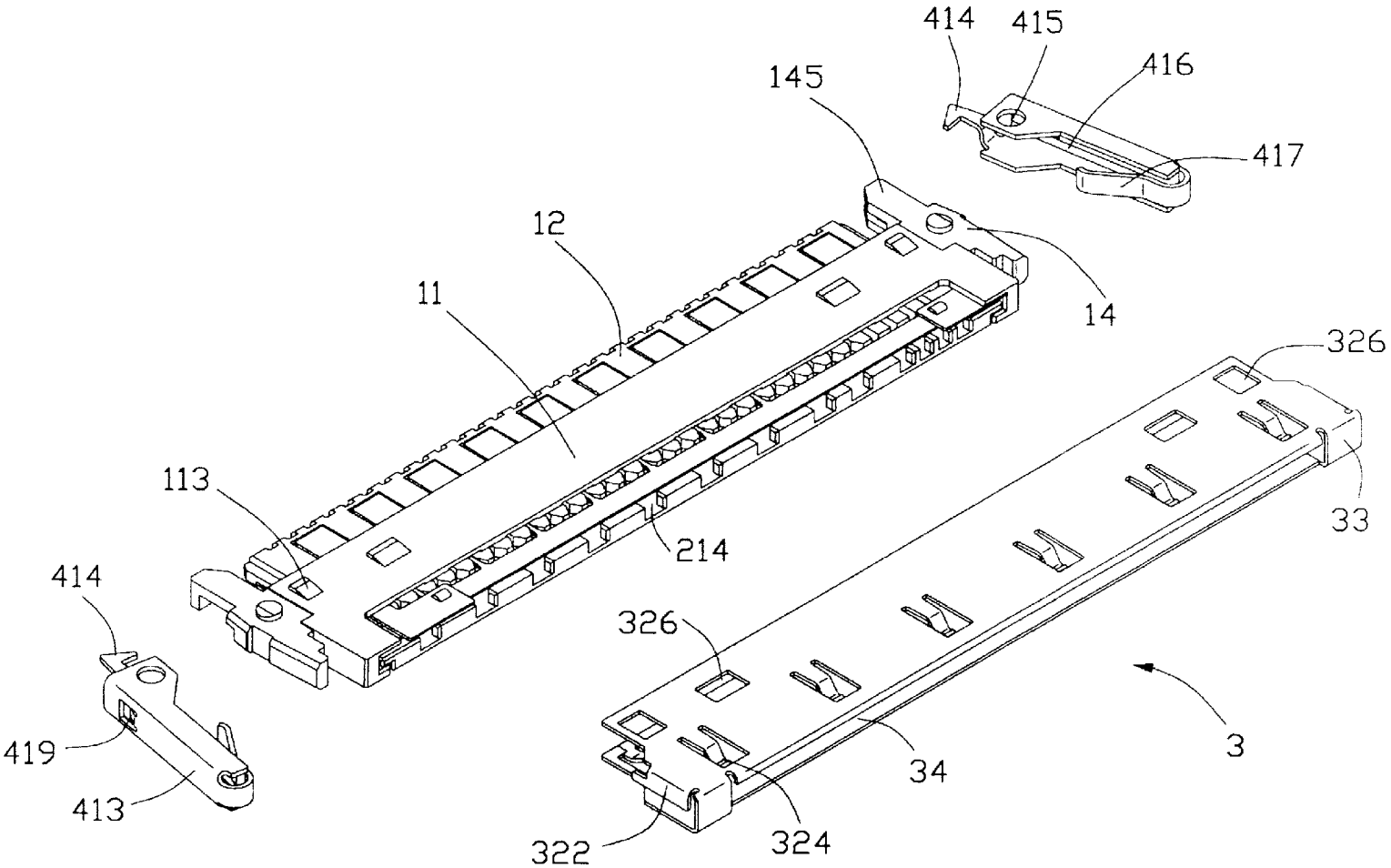
FIG. 5 is a view similar to FIG. 4, with more components of the connector being assembled together.

In assembly, also referring to FIGS. 4 and 5, the signal and grounding contacts 22 are respectively inserted into the channels 210 with the connecting sections 226 of the contacts 22 received in the channels 210, and the retention sections 222 and the mating sections 224 extending forwardly beyond the a front face of the insert 21. The grounding bar 23 is inserted into the receiving groove 212 with the grounding fingers 234 extending into corresponding channels 210 to electrically contact the grounding contacts of the contacts 22. Therefore, the contact set 2 is assembled together. The grounding plate 5 is put on a bottom face of the insert 21.

The contact set 2 together with the grounding plate 5 is then assembled to the elongate plate 131 of the rear portion 13 of the insulative housing 1 with lateral ends of the contact set 2 received in the receiving channels 133 of the receiving sections 132, respectively, and the retention sections 222 and the mating sections 224 of the contacts 22 extending into the passageways 111 of the housing 1, wherein the retention sections have an interferential fit with the housing 1.

The housing 1 is assembled into the receiving space 34 of the shield 3 with the plurality of protrusions 113 fitted into the apertures 326, the resilient tabs 324 extending into the receiving groove 212 and engaging with the grounding bar 23, and the resilient bars 312 engaging in the recesses 115 of the base portion 11 of the housing 1. The grounding plate 5 is located between the insert 21 and the lower plate 32 of the shield 3. Thus, the insulative housing 1, the contact set 2, the shield 3 and the grounding plate 5 are assembled together.

Figure 6:
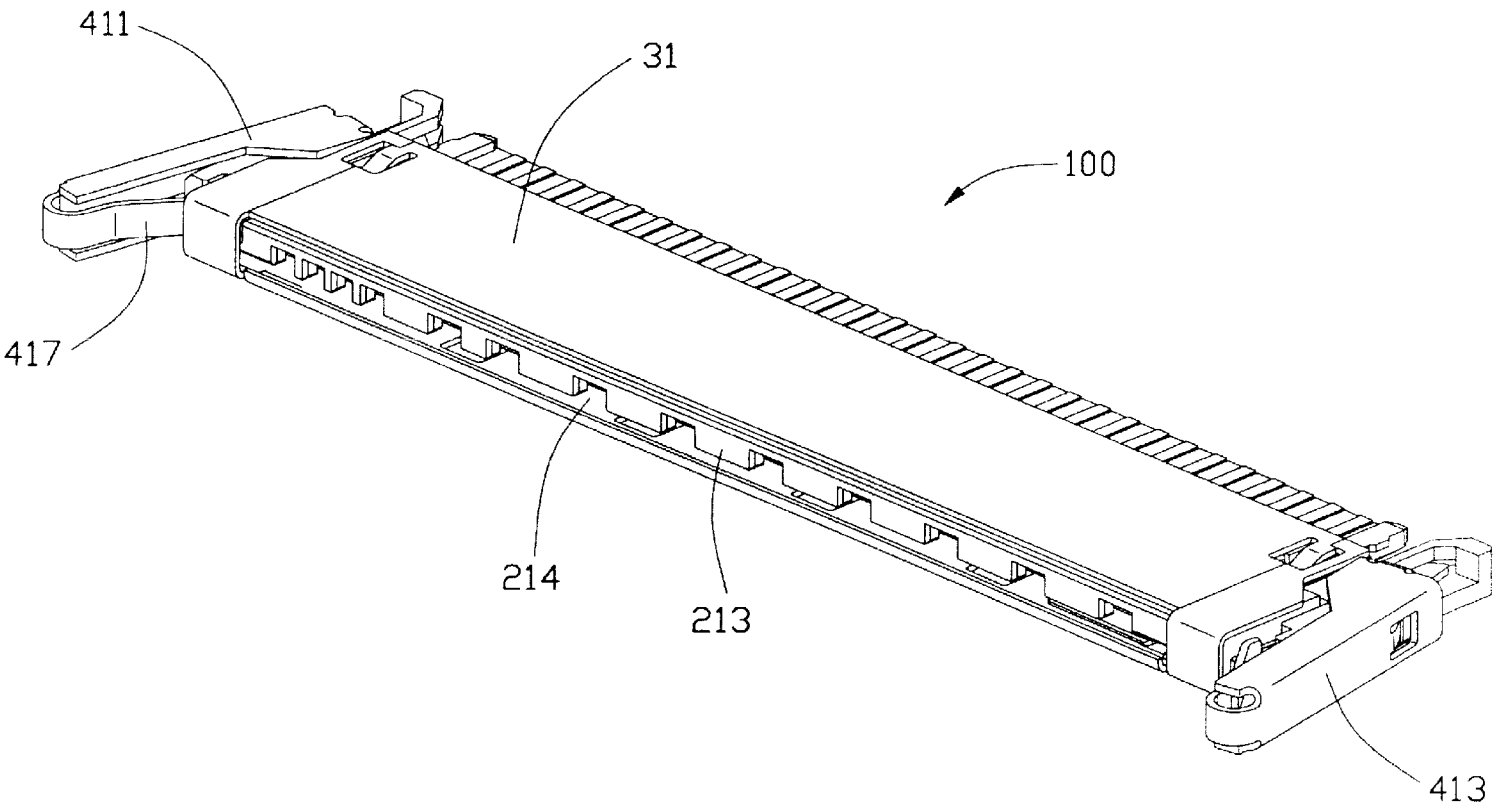
FIG. 6 is an assembled view of the micro coaxial cable connector of FIG. 1.
Figure 7:
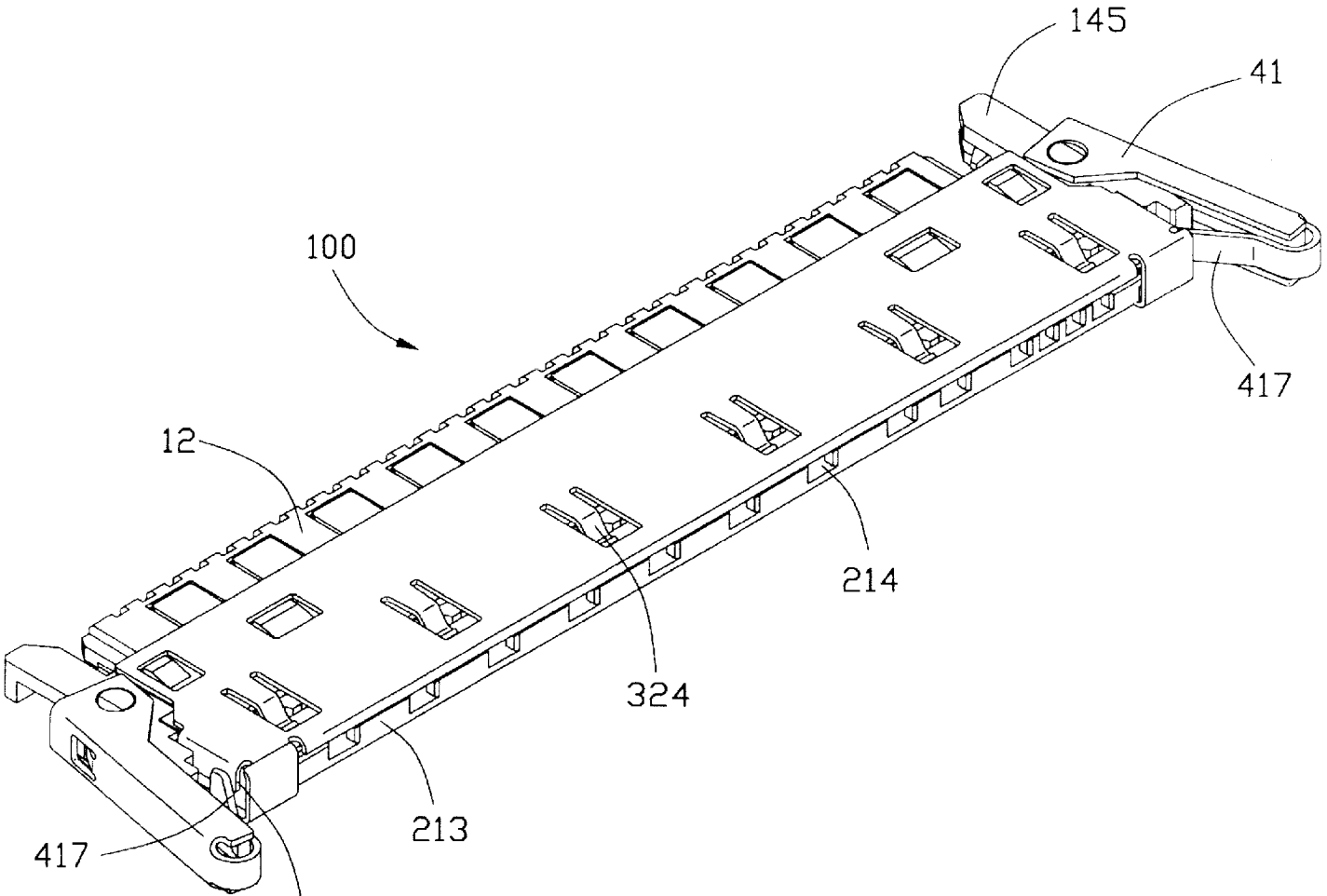
FIG. 7 is an assembled view of the micro coaxial cable connector of FIG.3.
Figure 8:
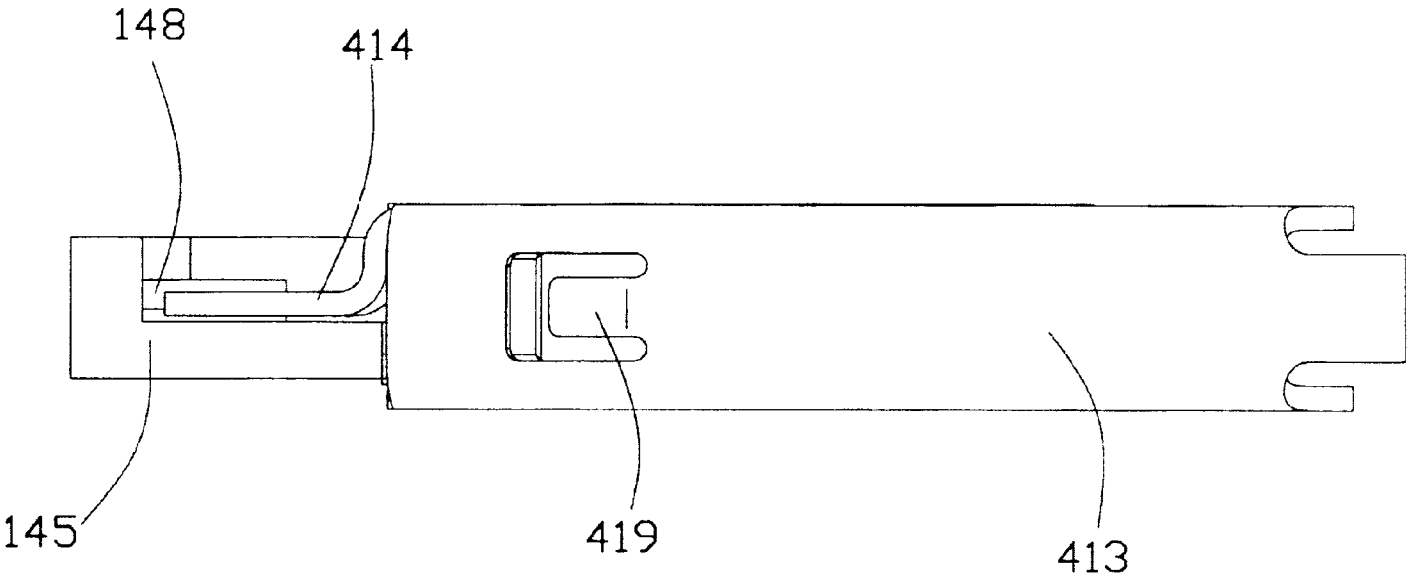
FIG. 8 is a side view of the micro coaxial cable connector of FIG. 7

Referring to FIGS. 6 to 8, the latch devices 4 are respectively assembled to the retention portions 14 of the housing 1 from laterally outside of the housing 1 to a position wherein the retention portions 14 are respectively inserted into the receiving cavities 416 of the body portions 410. The retention posts 142 are fitted into the retaining holes 415 so that the latch devices 4 are pivotably mounted on the retention portions 14, respectively. Each latch portion 414 extends through a corresponding passageway 148 to a position in inner of the upright wall 149 of the corresponding guiding post 145. The spring tabs 417 extend into the gaps 15 and resiliently abut against the side portions 322 of the shield 3 so that the latch devices 4 and the shield 3 are electrically connected together. The tabs 419 engage in the depressions 143 to more stably mount the latch devices 4 to the retention portions 14. Accordingly, the micro coaxial cable connector 100 in accordance with the present invention is completed.

When the micro coaxial cable connector 100 engages with the complementary connector (not shown), the latch portions 414 engage in recesses defined by the complementary connector to latch therewith, whereby the connector 100 and the complementary connector are securely connected together. To separate the connector 100 from the complementary connector, rear ends of the latch devices 4 are pushed towards each other to cause the latch devices 4 to pivot about the retention posts 142 in a manner that the latch portions 414 move away from each other to be pivoted away from each other. Thus, the latch of the connector 100 with the complementary connector is released and the connector 100 can be pulled to separate from the complementary connector. The tabs 419 have front ends (not labeled) engaging with the insulative housing 1, whereby a pulling force acting on the latch devices 4 by the complementary connector can be resisted by both the retention posts 142 and housing 1 engaging with the front ends of the tabs 419 so that the force acting on the retention posts 142 can be reduced to prevent damage of the retention posts 142 due to the pulling force.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an elongate insulative housing having a base portion, a plurality of passageways defined in the base portion, a pair of retention portions at a pair of lateral ends of the base portion;

a contact set assembled to a rear end of the housing and comprising an insulative insert, a plurality of signal and grounding contacts received in the insert, and a grounding bar assembled in the insert, the signal and grounding contacts extending into the passageways of the housing, the grounding bar having a plurality of grounding fingers electrically connecting the grounding contacts;

a grounding plate having a plurality of grounding fingers and at least one grounding beam, said at least one grounding beam electrically contacting the grounding bar of the contact set; and a pair of latch devices pivotably mounted to the retention portions of the housing, each latch device having a latch portion for latching with a complementary connector and a tab engaging with the housing for resisting a pulling force acting on the each latch device from the complementary connector; wherein the each latch device has a body portion enclosing a corresponding retention portion of the housing and pivotably mounted thereon, and the latch portion extends forwardly from the body portion, further comprising a shield enclosing the housing; wherein the shield has a pair of side portions formed on a pair of lateral ends thereof, and the each latch device has a spring tab extending from the body portion and abutting against a corresponding side portion of the shield; wherein each retention portion defies a guiding post extending forwardly therefrom, the guiding post forms an upright wall defining a passageway therein, the latch portion of the each latch device extending through a corresponding passageway.

2. The electrical connector as described in claim 1, wherein the body portion comprises an upper plate, a bottom plate, and a side plate connecting an edge of the upper plate and an edge of the bottom plate.

3. The electrical connector as described in claim 2, wherein the spring tab extends from the side plate of the body portion.

4. The electrical connector as described in claim 2, wherein the latch portion extends forwardly from the upper plate of the body portion.

5. The electrical connector as described in claim 2, wherein the tab is defined on the side plate of the body portion.

6. The electrical connector as described in claim 3, wherein the housing defines a pair of gaps in a rear end thereof, each gap is located between the base portion and a corresponding retention portion, and the spring tabs are received in the gaps.

7. The electrical connector as described in claim 6, wherein each retention portion integrally forms a retention post projecting from bottom face thereof, and the bottom plates of the body portions of the latch devices pivotably engage with the retention posts.

8. The electrical connector as described in claim 7, wherein the retention posts each have a bottom face with a laterally inclining portion.

9. An electrical connector comprising:

an insulative housing forming a pair of retention portions at lateral ends thereof, each retention portion having a guiding post at a front end thereof, the guiding post defining a passageway therein;

a contact set received in the insulative housing, comprising:

an insert;

a plurality of signal and grounding contacts received in the inserts, each contact having a mating portion extending in the insulative housing; and a grounding bar received in the insert and in electrically connection with the grounding contacts; and a pair of latch devices pivotably mounted to the retention portions of the housing, respectively, each latch device having a latch portion at a front end thereof, the latch portion extending through the passageway of the each guiding post adapted for latching with a complementary connector wherein the retention portions integral form retention posts, and the latch devices are pivotably mounted to retention posts; wherein the latch devices each forms a tab having a front end engaging with the insulative housing adapted for resisting a pulling force acting on the latch devices from the complementary connector;

further comprising a grounding plate electrically connecting with grounding bar.

10. The electrical connector as described in claim 9, further comprising a shield enclosing the insulative housing.

* * * * *